US010024327B2

(12) United States Patent
Tsutsui

(10) Patent No.: US 10,024,327 B2
(45) Date of Patent: Jul. 17, 2018

(54) TURBOMOLECULAR PUMP, AND METHOD OF MANUFACTURING ROTOR

(75) Inventor: Shingo Tsutsui, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 1806 days.

(21) Appl. No.: 13/390,630

(22) PCT Filed: Aug. 26, 2009

(86) PCT No.: PCT/JP2009/064838

§ 371 (c)(1),
(2), (4) Date: Apr. 25, 2012

(87) PCT Pub. No.: WO2011/024261

PCT Pub. Date: Mar. 3, 2011

(65) Prior Publication Data

US 2012/0207592 A1 Aug. 16, 2012

(51) Int. Cl.

| | |
|---|---|
| ***F04D 19/04*** | (2006.01) |
| ***F04D 29/32*** | (2006.01) |
| ***F04D 29/52*** | (2006.01) |
| ***F04D 29/38*** | (2006.01) |

(52) U.S. Cl.

CPC ..... *F04D 19/042* (2013.01); *F04D 29/388* (2013.01)

(58) Field of Classification Search

CPC .... F04D 29/023; F04D 29/388; F04D 19/042; F05D 2230/90; F05D 2300/611

USPC ..... 415/90

See application file for complete search history.

(56) References Cited

U.S. PATENT DOCUMENTS

| | | | | |
|---|---|---|---|---|
| 5,350,275 | A * | 9/1994 | Ishimaru | 415/90 |
| 7,572,096 | B2 * | 8/2009 | Nonaka et al. | 415/90 |

FOREIGN PATENT DOCUMENTS

| | | | |
|---|---|---|---|
| JP | 64-029290 | U | 2/1989 |
| JP | 10-122179 | A | 5/1998 |
| JP | 2000-161286 | A | 6/2000 |
| JP | 2005-325792 | A | 11/2005 |
| JP | 2005-337071 | A | 12/2005 |

(Continued)

OTHER PUBLICATIONS

Japanese Office Action dated Aug. 13, 2013, issued in corresponding Japanese Patent Application No. 2011-528543, w/English translation.

(Continued)

*Primary Examiner* — Jason Shanske
*Assistant Examiner* — Jesse Prager
(74) *Attorney, Agent, or Firm* — Westerman, Hattori, Daniels & Adrian, LLP

(57) ABSTRACT

A turbomolecular pump includes: a rotor (4) on which rotary vanes (19) in multiple stages are formed; fixed vanes (21) in multiple stages; and a pump casing (7) in which a pump inlet opening (7*a*) is defined, and that houses the rotor (4) and the fixed vanes (21) in multiple stages; wherein: a surface of the rotor (4) facing the inlet opening has a first emissivity; a surface of one vane stage that is visible from the inlet opening, among a plurality of vane stages including the rotary vanes (19) and the fixed vanes (21), has the first emissivity; and a surface of one vane stage, among the plurality of vane stages, that is not visible from the inlet opening has a second emissivity that is greater than the first emissivity.

6 Claims, 4 Drawing Sheets

(56) References Cited

FOREIGN PATENT DOCUMENTS

| | | | |
|---|---|---|---|
| JP | 2007-262581 | A | 10/2007 |
| WO | 02/075157 | A1 | 9/2002 |

OTHER PUBLICATIONS

International Search Report of PCT/JP2009/064838, dated Nov. 17, 2009.
Extended European Search Report dated Jan. 21, 2015, issued in corresponding European Patent Application No. 09848709.3 (7 pages).
Trial Decision dated Apr. 23, 2015, issued in corresponding Korean Patent Application No. 2014-7001154 (w/English translation) (15 pages).
Office Action dated Sep. 18, 2015, issued in counterpart EP Application No. 09 848 709.3. (4 pages).

* cited by examiner (a)

(b)

TURBOMOLECULAR PUMP, AND METHOD OF MANUFACTURING ROTOR

TECHNICAL FIELD

The present invention relates to a turbomolecular pump, and to a method of manufacturing a rotor of a turbomolecular pump.

BACKGROUND ART

A turbomolecular pump is used for evacuation of a semiconductor manufacturing equipment or of an analysis equipment or the like. For example, with an electronic microscope or a photolithography equipment for which extremely high measurement accuracy and processing accuracy and so on are demanded, very rigorous temperature management is performed since change of temperature exerts an influence on the accuracy.

CITATION LIST

Patent Literature

Patent Document #1: Japanese Laid-Open Patent Publication 2005-337071.

SUMMARY OF INVENTION

Technical Problem

Now with a turbomolecular pump the heat dissipation due to heat conduction is extremely small, because the rotor is in vacuum. Due to this, the temperature of the rotor can easily rise due to generation of heat by gas evacuation and generation of heat by the motor and so on. If the temperature of the rotor has risen and it is directly visible from the equipment side through the pump inlet opening, then there is a fear that radiation heat from the rotor may directly arrive at high accuracy components provided within the equipment (for example a lens or the like in an optical system) and that temperature change thereof will be caused, and this may influence their accuracy.

Solution to Problem

A turbomolecular pump according to the present invention comprises: a rotor on which rotary vanes in multiple stages are formed; fixed vanes in multiple stages; and a pump casing in which a pump inlet opening is defined, and that houses the rotor and the fixed vanes in multiple stages; wherein: a surface of the rotor facing the inlet opening has a first emissivity; a surface of one vane stage that is visible from the inlet opening, among a plurality of vane stages including the rotary vanes and the fixed vanes, has the first emissivity; and a surface of one vane stage, among the plurality of vane stages, that is not visible from the inlet opening has a second emissivity that is greater than the first emissivity.

A turbomolecular pump according to the present invention comprises: a rotor on which rotary vanes in multiple stages are formed; fixed vanes in multiple stages; and a pump casing in which a pump inlet opening is defined, and that houses the rotor and the fixed vanes in multiple stages; wherein: a surface of the rotor facing the inlet opening has a first emissivity; surface regions of the rotary vanes and the fixed vanes that include at least regions thereof that are visible from the inlet opening have the first emissivity; and rear surface sides of the rotary vanes and the fixed vanes facing in direction opposite to the inlet opening have a second emissivity that is greater than the first emissivity.

A turbomolecular pump according to the present invention comprises: a rotor on which rotary vanes in multiple stages are formed; fixed vanes in multiple stages; and a pump casing in which a pump inlet opening is defined, and that houses the rotor and the fixed vanes in multiple stages; wherein: a surface of the rotor facing the inlet opening and a surfaces of the rotary vanes and the fixed vanes that face towards the inlet opening have a first emissivity; and a rear surface sides of the rotary vanes and the fixed vanes facing in direction opposite to the inlet opening have a second emissivity that is greater than the first emissivity.

It should be understood that, among a plurality of vane stages constituted by the rotary vanes and the fixed vanes, a surface of a vane stage that is invisible from the inlet opening may have the second emissivity.

Further, it should be acceptable that the turbomolecular pump may further comprise a cylindrical threaded rotor that is more towards gas outlet flow side than the rotary vanes in multiple stages and that is formed integrally with the rotor, and a cylindrical threaded stator that is provided so as to oppose outer circumferential surface of the threaded rotor; and wherein, among surfaces of the threaded rotor and the threaded stator, mutually opposing surfaces at least have the second emissivity.

Yet further, it should be accepted that the cylinder inner surface of the threaded rotor and a pump base surface that includes a face that opposes the cylinder inner surface have the second emissivity.

A method of manufacturing a rotor used in a turbomolecular pump according to the present invention comprises: a first process of performing non-electrolytic nickel plating processing upon surface of the rotor that is made from aluminum; a second process of performing non-electrolytic black nickel plating processing upon upper surface of non-electrolytic nickel plating that has been formed upon the rotor; and a third process of, after the second process, exposing the non-electrolytic nickel plating by performing blasting processing upon a surface of the rotor that is included in the first region; wherein the surface where the non-electrolytic nickel plating is exposed is made as a surface having the first emissivity, and the surface where the non-electrolytic black nickel plating is exposed is made as a surface having the second emissivity.

Advantageous Effect of the Invention

According to the present invention, it is possible to facilitate reduction of the temperature of the rotor, and reduction of emission of heat to the equipment to which the pump is installed.

BRIEF DESCRIPTION OF THE DRAWINGS

FIG. 2(*a*) shows rotary vanes of a first stage, while FIG. 2(*b*) shows rotary vanes of a second stage;

DESCRIPTION OF THE EMBODIMENTS

In the following, a preferred embodiment of the present invention will be explained with reference to the drawings.

Figure 1:
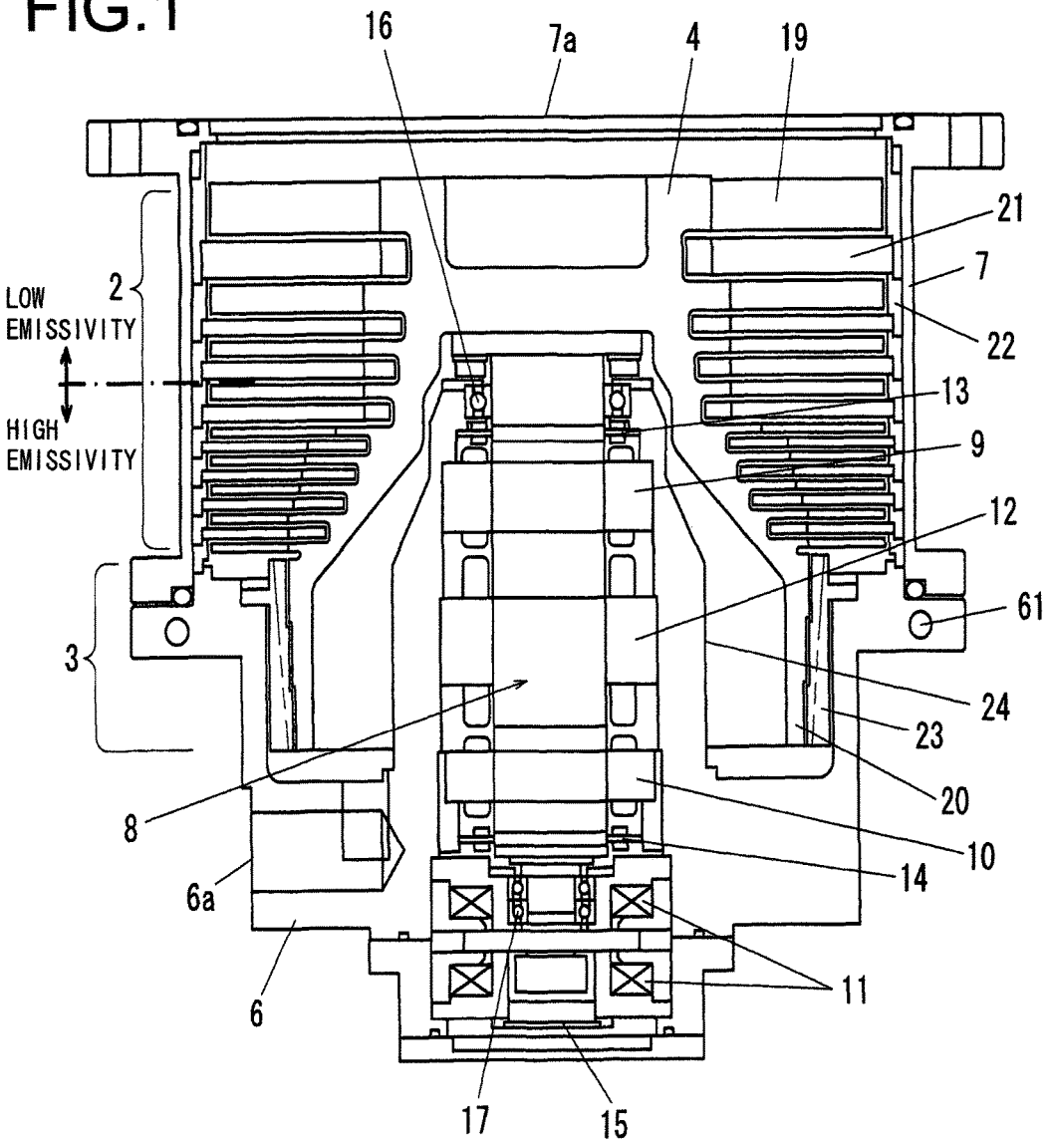
FIG. 1 is a sectional view showing a turbomolecular pump according to an embodiment of the present invention.

FIG. 1 is a sectional view showing an embodiment of the turbomolecular pump according to the present invention, and is a sectional view of a magnetic bearing type turbomolecular pump 1. The turbomolecular pump shown in FIG. 1 is a turbomolecular pump of a type that can handle a high gas load, and that has a turbomolecular pump unit 2 and a thread groove pump unit 3. The turbomolecular pump unit 2 is built with multiple moving vane stages 19 and multiple stationary vane stages 21, and the thread groove pump unit 3 is built with a threaded rotor 20 and a threaded stator 23.

The multiple moving vane stages 19 and the threaded rotor 20 are formed on a rotor 4, and this rotor 4 is fixed on a rotation shaft 8 that is provided within a spindle housing 24 so as to rotate freely. Within the spindle housing 24, in order from the top of the figure, there are provided: an upper portion radial sensor 13, an upper portion radial electromagnet 9, a motor stator 12, a lower portion radial electromagnet 10, a lower portion radial sensor 14, and a thrust electromagnet 11.

The rotation shaft 8 is supported in a non-contact manner by the radial electromagnets 9 and 10 and the thrust electromagnet 11, and is rotationally driven by a DC motor that consists of the motor stator 12 and a motor rotor of the rotation shaft side. The position where the rotation shaft 8 is floating is detected by the radial sensors 13 and 14 and the thrust sensor 15 that are provided to correspond to the radial electromagnets 9 and 10 and to the thrust electromagnet 11. Protective bearings 16 and 17 that are provided at the top and bottom of the rotation shaft 8 are mechanical bearings, and, along with supporting the rotation shaft 8 if the magnetic bearings do not operate, also function to limit the position of flotation of the rotation shaft 8.

On the other hand, the plurality of stationary vanes 21 and the threaded stator 23 are provided on a base 6 within the casing 7. The stationary vanes 21 are supported on the base 6 so as to be sandwiched between annular spacers 22 above and below, and the stationary vanes 21 and the spacers 22 are fixed between the upper end of the casing 7 and the base 6 by the casing 7 being engaged to the base 6 by bolts. As a result, the stationary vanes 21 are positionally determined in predetermined positions between the moving vanes 19. The threaded stator 23 is engaged upon the base 6 by bolts.

Gas molecules that have flowed in from an inlet opening 7*a* are struck by the turbomolecular pump unit 2 and fly off downwards as seen in the figure, and are compressed and expelled towards the downstream side. The threaded rotor 20 is provided so as to approach close to the inner circumferential surface of the threaded stator 23, and a helical groove is formed on the inner circumferential surface of the threaded stator 23. Evacuation of gas is performed by the threaded groove pump unit 3 due to viscous flow, by the helical groove of the threaded stator 23 and by the threaded rotor 20 that rotates at high speed. The gas molecules that have been compressed by the turbomolecular pump unit 2 are further compressed by the threaded groove pump unit 3, and are expelled from a gas outlet opening 6*a*.

A cooling system 61 such as a cooling water path or the like is provided to the base 6. It is arranged for the heat generated by the motor 12 and the electromagnets 9, 10, and 11 to be removed by the base 6 being cooled by the cooling system 61. Moreover, since heat is generated while the gas is evacuated, it is arranged to remove this generated heat by cooling the threaded stator 23, the spacers 22, and the fixed vanes 21 via the base 6. Furthermore, it is difficult for the rotor 20 to dissipate heat because it is floating in vacuum, and accordingly its temperature can easily become elevated due to generation of heat during the gas evacuation. Thus, by cooling the fixed vanes 21 and so on that closely oppose the rotor 20, cooling of the rotor 20 by taking advantage of radiation heat may be facilitated.

Figure 2:
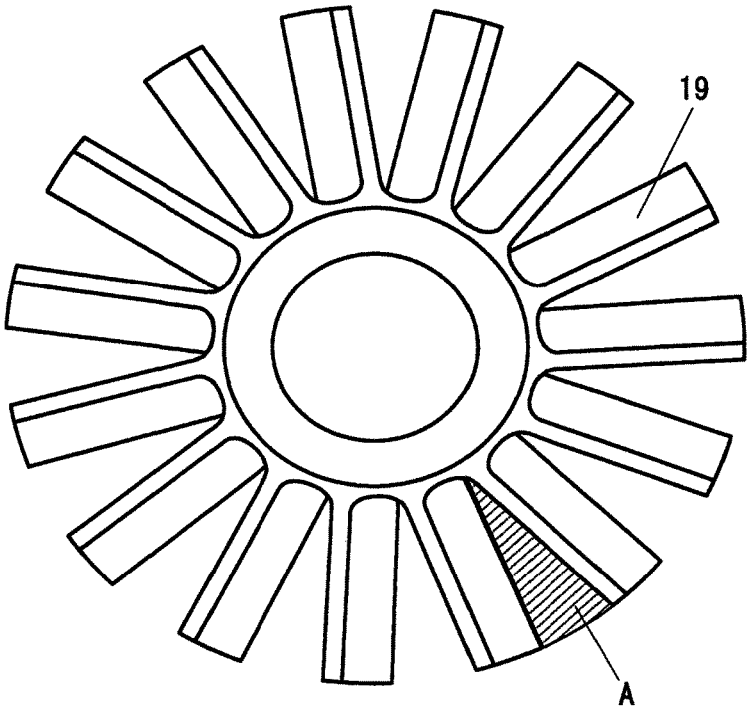
FIG. 2 consists of plan views of a rotor as seen from an inlet opening 7*a*.
Figure 2:
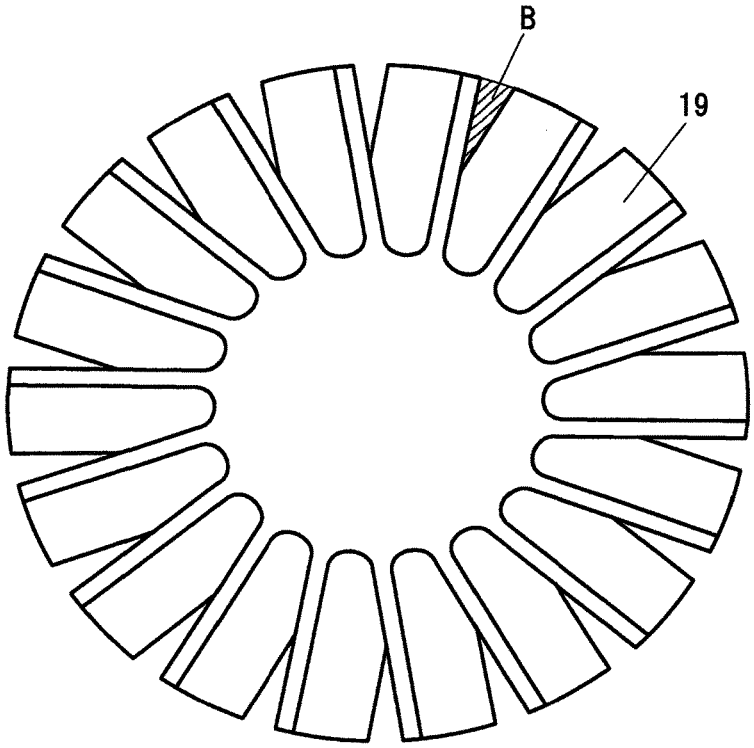
Figure 3:
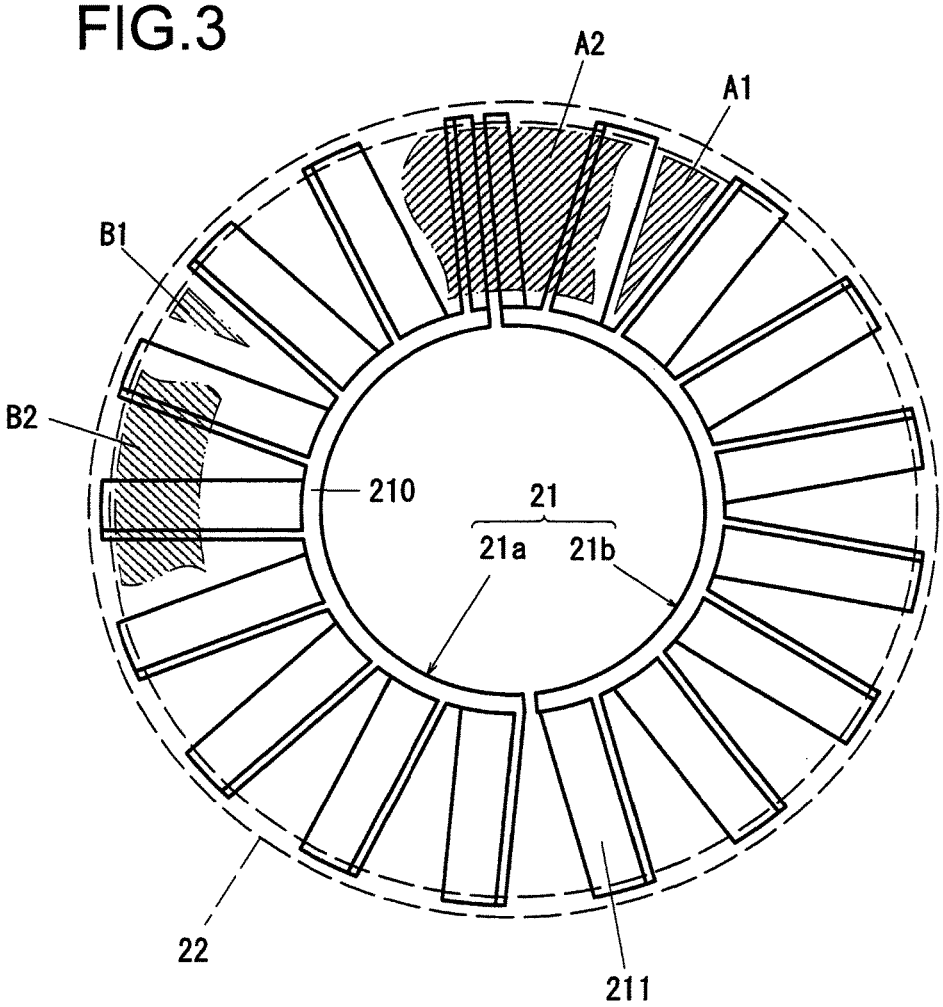
FIG. 3 is a plan view of fixed vanes 21.

FIGS. 2 and 3 are figures for explanation of the rotary vanes 19 and the fixed vanes 21. FIG. 2(*a*) is a figure showing the first stage of the rotary vanes 19 formed on the rotor 4, and is a plan view of the rotor 4 as seen from the side of the inlet opening 7. And FIG. 2(*b*) is a plan view of the rotary vanes 19 of the second stage. The rotary vanes 19 consist of a plurality of blades formed extending radially, each having a certain vane angle. In the turbomolecular pump shown in FIG. 1, the rotary vanes 19 are formed in eight stages.

Design parameters of the rotary vanes 19 are set for each stage, for example the heights of the rotary vanes 19, their vane angles, the number of vanes, and so on. Generally, the vane heights and the vane angles become smaller towards the downstream side where the gas is expelled, and their opening ratio also becomes smaller. As will be understood upon comparison of the rotary vanes 19 in FIGS. 2(*a*) and 2(*b*), the area of the openings B of the second stage has become smaller than the area of the openings A of the first stage.

FIG. 3 is a plan view of the fixed vanes 21. While seven stages of fixed vanes 21 are formed in the example shown in FIG. 1, the first stage of fixed vanes 21 is shown in FIG. 3. In order for it to be possible to assemble the fixed vanes 21, they are made as circular disk shaped objects, divided into two into separate fixed vane halves 21*a* and 21*b*. Each of the fixed vanes 21*a* and 21*b* is made from a half annular rib portion 210 and a plurality of vane portions 211 that are formed as extending radially from that rib portion. The external circumferential portions of the vane portions 211 are sandwiched between the annular spacers 22, as shown by the broken line. As will be understood from FIGS. 2 and 3, for the rotary vanes 19 and the fixed vanes 21, the directions of inclination of the vanes are opposite.

Since, as previously described, the radiation heat that has passed from the pump side through the inlet opening 7*a* to the equipment side exerts a negative influence upon the equipment side, accordingly, with the turbomolecular pump of this embodiment, it is arranged to suppress the influence of radiation heat by providing a structure as explained below. Moreover, with this structure, the heat of the rotor 4 that is magnetically suspended efficiently escapes as radiation heat to the stator side such as the fixed vanes or the like, so that the temperature of the rotor is kept low.

Since radiant heat from the pump side reaches the equipment side via the inlet opening 7*a*, accordingly, as a design objective, it is contemplated to reduce the influence of heat radiation by suppressing this radiation heat. In this embodiment it is arranged to make the emissivity small, at least for the region that can be seen from the equipment side through the inlet opening 7*a*. Moreover, for the region that cannot be seen through the inlet opening 7*a*, it is arranged to make the emissivity great by performing blackening processing or the like.

In this embodiment, the region that can be seen from the equipment side when the pump is viewed from the equipment side through the inlet opening 7*a* will be termed the "visible region", while the region that is hidden in the shadow of the rotary vanes of the front stage or the fixed vanes and cannot be seen from the equipment side will be termed the "invisible region".

The sectors A1 and B1 in FIG. 3 are ones in which the openings A and B shown in FIG. 2 have been projected upon the fixed vanes 21. Since the rotary vanes 19 rotate with respect to the fixed vanes 21, accordingly the projected images A1 and A2 also come to rotate over the fixed vanes 21. As a result, the region that can be seen from the inlet opening 7*a* through the opening A becomes the circular annular region B2, and the region that can be seen through the opening B becomes the circular annular region B2. It should be understood that, in FIG. 3, only portions of the circular annular regions B1 and B2 are shown. Furthermore, it is also possible to see the rotary vanes 19 and fixed vanes 21 of subsequent stages from between the fixed vanes 21.

Concerning Emissivity

In this embodiment, whether the surface of each member is made to be of low emissivity or is made to be of high emissivity is determined according to whether or not it can be seen from the equipment side via the inlet opening 7*a*. In relation to the dividing line between low emissivity and high emissivity, in this embodiment, in outline, a case in which the emissivity is less than or equal to 0.2 is taken as being low emissivity, while a case in which the emissivity is greater than or equal to 0.5 is taken as being high emissivity.

Generally, with a turbomolecular pump, aluminum alloy is used for the rotor 4 and for the fixed vanes 19. In the case of aluminum alloy, it has low emissivity when it is used only as base material without any surface processing being performed, since its emissivity is around 0.1. Moreover, when resistance to corrosion is to be imparted in addition to low emissivity, processing such as nickel plating (non-electrolytic nickel plating) or the like may be performed upon the base material. On the other hand, when high emissivity is to be imparted, surface processing such as alumite processing, non-electrolytic black nickel plating, plating with a ceramic compound, or the like may be performed. It is possible to bring the emissivity to 0.7 or greater by performing alumite processing or non-electrolytic black nickel plating. And, when resistance to corrosion is to be imparted, non-electrolytic black nickel plating is used in this case as well.

Concerning Regions of Low Emissivity and Regions of High Emissivity

As shown in FIGS. 2 and 3, since openings are defined by the rotary vanes 19 and the fixed vanes 21, not only the upper surface of the rotor 4 and the rotary vanes 19 of the first stage, but also the fixed vanes 21 and the rotary vanes 19 of the second stage and subsequently can be seen from the equipment side through the inlet opening 7*a*. Actually, because the positions of the openings of the rotary vanes 19 are different for each stage, and also because the positions where the fixed vanes 21*a* and 21*b* are divided are different for each stage, accordingly it is not necessarily the case that the positions of the openings will coincide with one another above and below.

In this embodiment it will be hypothesized and the explanation will assume that it is possible to see as far as the sixth stage where the stages of the rotary vanes 19 and the fixed vanes 21 are counted together. In other words, up to the sixth stage are endowed with low emissivity, while, in downstream side from the sixth stage, the rotary vanes 19, the fixed vanes 21, and the threaded groove pump unit 3 (the threaded rotor 20 and the threaded stator 23) are endowed with high emissivity.

In the following, three representative types of concrete combinations of the above processes will be explained. Here, the pump structural elements that are the subjects of processing are the rotor 4, the rotary vanes 19, the fixed vanes 21, the threaded groove pump unit 3, and the surface of the base. Moreover, a conceptual distinction is made between those pump structural elements that do have visible regions even though they may be small (up to the sixth stage), these being considered as elements of upper evacuating system portion, and those pump structural elements that have absolutely no visible regions at all, these being considered as elements of lower evacuating system portion. Thus, the surfaces (hereinafter termed the upper surfaces) of the rotor 4, and the rotary vanes 19 and the fixed vanes 21, that face the inlet opening 7*a* are considered as being elements of upper evacuating system portion. Moreover, the rotary vanes 19 and the fixed vanes 21 that are not included in the elements of upper evacuating system portion, and the threaded groove pump unit 3 and the base surface, are considered as being elements of lower evacuating system portion.

Type #1

In this type, the surfaces of the elements of upper evacuating system portion are made to be of low emissivity, while the surfaces of the elements of lower evacuating system portion are made to be of high emissivity. In concrete terms, the upper surface of the rotor 4 and the entire surfaces of the vane stages from the first stage to the sixth stage (i.e. of the rotary vanes 19 and the fixed vanes 21) are made to be of low emissivity. On the other hand, the entire surfaces of the vane stages from the seventh stage to the fifteenth stage, at least the opposing surfaces of the threaded rotor 20 and the threaded stator 23, and the base surface that faces the gas outlet flow conduit, are made to be of high emissivity. It should be understood that it would also be acceptable to make the entire surface of the threaded stator 23 to be of high emissivity, and it would also be acceptable to make the surface of the spindle housing 24 and the inner circumferential surface of the rotor 4 that opposes this surface to be of high emissivity.

Type #2

In this type, the upper surface of the rotor 4 and the surfaces of the rotary vanes 19 and the fixed vanes 21 that are visible from the inlet opening 7 are made to be of low emissivity. On the other hand, the rear surfaces of the rotary vanes 19 and the fixed vanes 21 are made to be of high emissivity. By adopting this type of structure, it is possible to reduce the radiation heat towards the equipment side, while also it is possible to facilitate reduction of the temperature of the rotor 4, since its rear surface is made to be of high emissivity.

It should be understood that, even if fixed vanes of the same vane shape are used over multiple stages, in some cases the visible regions will be different, as shown by the regions A2 and B2 in FIG. 3. Due to this, if a mistake is made in the order of assembly, then the radiation heat towards the equipment side may undesirably become greater as compared to the case of normal assembly. In this type of case, it is possible to prevent emission of heat due to the above described type of mistake by using in common fixed vanes 21 in which the regions A2 have been made to be of low emissivity for the corresponding multiple stages.

Moreover it would also be acceptable, in a similar manner to the case with Type #1, to arrange to make the surfaces of the elements of lower evacuating system portion, in other words the entire surfaces of the vane stages from the seventh stage to the fifteenth stage, at least the opposing surfaces of the threaded rotor 20 and the threaded stator 23, and the base surface that faces the gas outlet flow conduit, to be of high emissivity. By adopting this type of structure, it is possible to make greater the heat transfer from the rotor 4 to the stator side due to radiation heat.

Type #3

In Type #3, the upper surface of the rotor 4 and the front surface sides of the rotary vanes 19 and the fixed vanes 21 of all of the vane stages are made to be of low emissivity, while the rear surface sides of the rotary vanes 19 and the fixed vanes 21 of all of the vane stages are made to be of high emissivity. It is possible to reduce the heat radiation towards the equipment side by adopting this type of structure, since the regions that are visible from the inlet opening 7*a* are made to be of low emissivity. Moreover, by making the rear surface side of the rotor 4 to be of high emissivity, it is possible to increase the radiation heat from the rotor 4 to the stator side, and it is possible to suppress elevation of the temperature of the rotor 4.

In the case of this type #3 as well, in a similar manner to the case of the type #2, it would also be possible to arrange to make the entire surfaces of the vane stages from the seventh stage to the fifteenth stage, at least the opposing surfaces of the threaded rotor 20 and the threaded stator 23, and the base surface that faces the gas outlet flow conduit to be of high emissivity.

Next, an example of the surface processing in the case of the above Type #1 will be explained in concrete terms. First, in a first example, the elements of upper evacuating system portion are left as they are in the state of the aluminum base material, while the elements of lower evacuating system portion are processed by alumite processing or by non-electrolytic black nickel processing. This method may be applied when resistance to corrosion is not required.

A second example is applied when it is necessary for the rotor 4 (including the rotary vanes 19) to be resistant to corrosion. Since centrifugal force acts upon the rotor 4, accordingly, in a corrosive environment, there is a fear that it may break due to stress corrosion. Thus surface processing is performed to endow the rotor 4, this being an element in the upper evacuating system portion, with low emissivity and moreover with excellent resistance to corrosion. For example, non-electrolytic nickel plating may be performed at a phosphorous density of 7% or higher. With non-electrolytic nickel plating the emissivity is around 0.2, and, by ensuring a phosphorous density of 7% or higher, non-electrolytic nickel plating is formed that has appropriate resistance to corrosion. Moreover, since no centrifugal force as in the case of the rotary vanes 19 is applied to the fixed vanes 21, accordingly the fixed vanes 21 that are included in the upper evacuating system portion and that are made from the aluminum base material may be left just as they are.

On the other hand, since centrifugal force is applied to the rotor 4 (the rotary vanes 19 and the threaded rotor 20) that is included in the elements of lower evacuating system portion, accordingly, after having performed non-electrolytic nickel plating upon these elements at a phosphorous density of 7% or greater in order to confer resistance to corrosion, subsequently the emissivity is made high by further performing non-electrolytic black nickel plating. Moreover, either alumite processing, or non-electrolytic black nickel processing, or plating with a ceramic compound may be performed upon the fixed vanes 21, the threaded stator 23, and the base surface that are included in the elements of lower evacuating system portion, so as to make their emissivity high.

It should be understood that the number of stages described above (six stages) is not to be considered as being limitative, since up to which stage the stages should be made to be of low emissivity varies depending upon the vane design because up to which stage the rotary vanes 19 and the fixed vanes 21 can be seen is different depending upon the design objectives for these vanes.

Figure 4:
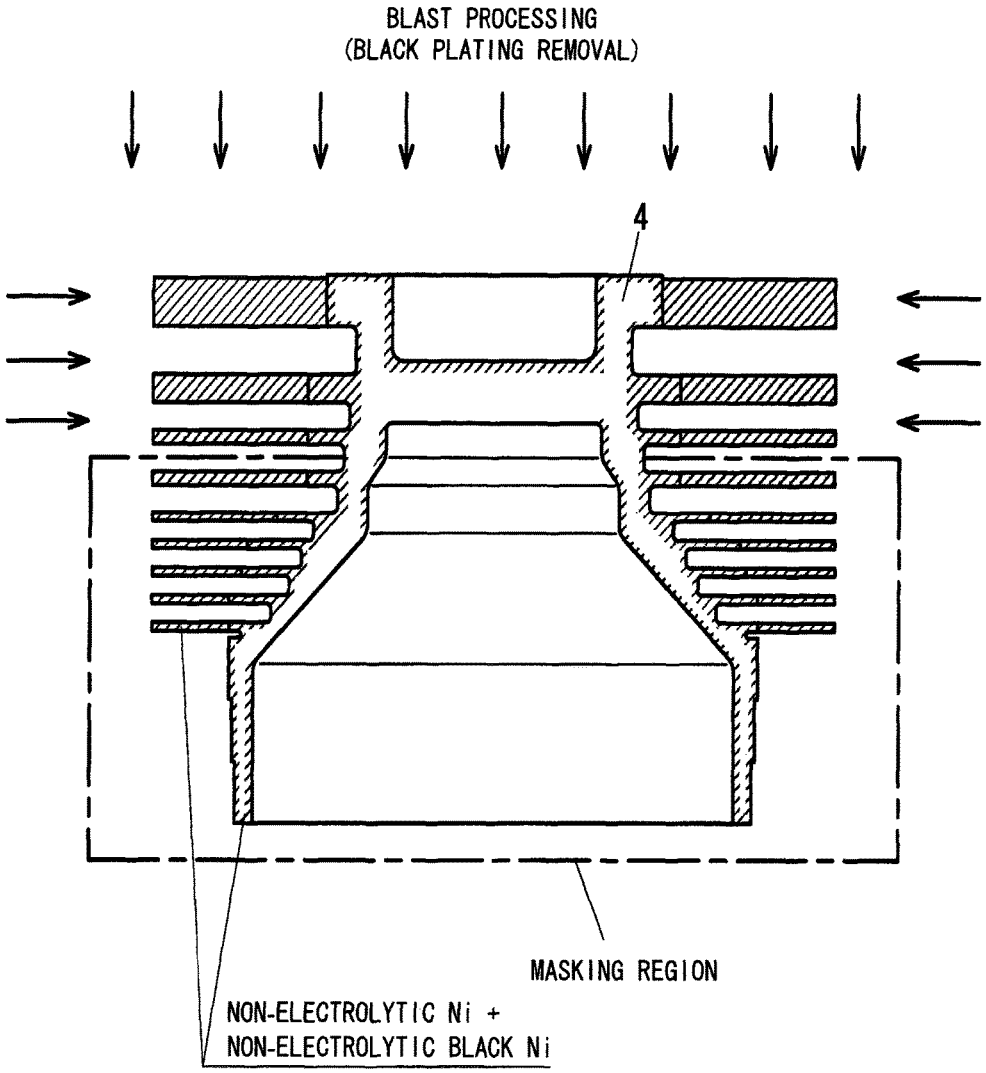
FIG. 4 is a figure for explanation of surface processing of the rotor 4.

Next, the method for surface processing the surface of the rotor 4 in the second example described above will be explained. First, in a first process, non-electrolytic nickel plating at a phosphorous density of 7% or greater is performed upon the rotor 4, on which the rotary vanes 19 and the threaded rotor 20 are formed. Next, in a second process, non-electrolytic black nickel plating processing is performed over this non-electrolytic nickel plating (refer to FIG. 4). As shown in FIG. 4, this non-electrolytic nickel plating processing and this non-electrolytic black nickel plating processing are also performed on the inner peripheral surface of the bell shaped portion of the rotor 4. It should be understood that non-electrolytic black nickel plating processing is also performed on the surface of the spindle housing 24 that opposes this surface (refer to FIG. 1), and it is anticipated that thereby the heat transfer due to radiation of heat from the rotor 4 to the stator side will be enhanced.

Then, in a third process, the elements of lower evacuating system portion of the rotor 4, in other words the regions that are lower than the rotary vanes 19 of the fourth stage, are masked so that blast particles do not impinge upon them, and then the covering of non-electrolytic black nickel plating that was performed upon the elements of upper evacuating system portion is removed. It should be understood that the method of masking is not to be considered as being limited, since any method will be acceptable, provided that it can eliminate the influence of blasting; for example, it would also be acceptable just to cover over all the elements of lower evacuating system portion with a bag. Then it is possible to remove the non-electrolytic black nickel plating on both the upper surfaces and the lower surfaces of the rotary vanes 19 by blasting, not only from above the rotor as shown in FIG. 4, but also from the side of the rotary vanes 19 and/or from downwards. By removing the non-electrolytic black nickel plating by this third process, the surfaces on the elements of upper evacuating system portion which are processed by non-electrolytic nickel plating and that can be seen from the inlet opening become exposed.

By doing this, it is simple and easy to form surfaces having high emissivity (i.e. surfaces that are plated with non-electrolytic black nickel) and surfaces having low emissivity (i.e. surfaces that are plated with non-electrolytic nickel). Moreover, by using blasting processing, it is simple and easy to remove the non-electrolytic black nickel plating from only the desired regions.

It should be understood that the method of eliminating the non-electrolytic black nickel plating is not to be considered as being limited to the blast processing described above; it would also be acceptable, for example, to arrange to eliminate the non-electrolytic black nickel plating by acid processing with, for example, hydrochloric acid or nitric acid or the like. Moreover, it would also be possible to arrange to remove the non-electrolytic black nickel plating from only the upper surfaces of the rotary vanes 19 by projecting the blasting material from above the rotor during the blasting processing. Furthermore, by only projecting the blasting material from above the rotor, it would also be acceptable to arrange to remove the non-electrolytic black nickel plating in relation to the portions of the rotary vane upper surfaces that can be seen. Of course, since the fixed vanes 21 are arranged to alternate with the rotary vanes 19, accordingly the non-electrolytic black nickel plating comes to be removed from regions on the upper surfaces of the fixed vanes that are broader than the regions that actually can be seen.

Now, while these processes have been explained in relation to surface processing of the rotor 4, also in the case of the fixed vanes 21, after having performed non-electrolytic nickel plating processing and non-electrolytic black plating processing, blasting processing is performed over the entire regions of the fixed vane upper surfaces as well.

Since, as described above, in this embodiment, the emissivity of the regions that can be seen from the inlet opening 7*a* is low, accordingly it is possible to keep the radiation heat emitted through the inlet opening 7*a* to the equipment side low. Moreover, since surface processing is performed upon the region that cannot be seen from the inlet opening 7*a* so that its emissivity becomes high, accordingly it is possible to make the amount of radiation heat from the rotor 4 to the stator side (for example to the fixed vanes 21) high, and it is possible to suppress elevation of the temperature of the rotor 4. And, by suppressing elevation of the temperature in this manner, it is possible to further reduce the amount of heat radiated to the equipment side.

It should be understood that while, in the above explanation, it was hypothesized that cooling of the fixed vanes 21 is performed effectively by the cooling system 61, so that the temperature of the fixed vanes 21 is lower than that of the rotary vanes 19, if the amount of heat generated in the threaded groove pump unit 3 is large, or if the cooling capacity is not sufficient, then there is a fear that the temperature of the lower evacuating system portion will become higher than that of the upper evacuating system portion. In this type of case, it would be acceptable to make the spacer 22 between the upper evacuating system portion and the lower evacuating system portion (i.e. the fourth spacer from the top in FIG. 1) from a material whose thermal conductivity is low (for example from stainless steel), so that conduction of heat from the lower portion to the upper portion is suppressed, and so that thereby elevation of the temperature of the upper evacuating system portion is suppressed.

While, in the embodiment described above, an example was explained of a turbomolecular pump equipped with a threaded groove pump stage, it would also be possible to apply the present invention to a full vane type turbomolecular pump that has no threaded groove pump stage. Moreover, the present invention can also be applied to a mechanical bearing type turbomolecular pump, rather than to a magnetic bearing type pump. Furthermore, provided that the defining features of the present invention are not lost, the present invention should not be considered as being in any way limited by the embodiment described above, and the embodiment and variant embodiments described above could also be combined in any manner.

The invention claimed is:

1. A turbomolecular pump, comprising:

a rotor on which rotary vanes in multiple stages are formed;

fixed vanes in multiple stages; and a pump casing in which a pump inlet opening is defined, and that houses the rotor and the fixed vanes in multiple stages; wherein:

a surface of the rotor facing the inlet opening has a first emissivity;

a surface of all vane stages that are visible from the inlet opening, among a plurality of vane stages including the rotary vanes and the fixed vanes, have the first emissivity; and a surface of one vane stage, among the plurality of vane stages, that is not visible from the inlet opening has a second emissivity that is greater than the first emissivity.

2. A turbomolecular pump according to claim 1, further comprising a cylindrical threaded rotor that is more towards gas outlet flow side than the rotary vanes in multiple stages and that is formed integrally with the rotor, and a cylindrical threaded stator that is provided so as to oppose outer circumferential surface of the threaded rotor; and wherein, among surfaces of the threaded rotor and the threaded stator, mutually opposing surfaces at least have the second emissivity.

3. A turbomolecular pump according to claim 2, wherein cylinder inner surface of the threaded rotor and a pump base surface that includes a face that opposes the cylinder inner surface have the second emissivity.

4. A turbomolecular pump according to claim 3, wherein:

the rotor, the fixed vanes, the threaded stator, and the pump base are made from aluminum;

the first emissivity is imparted by exposing the aluminum base material; and the second emissivity is imparted by performing alumite processing or non-electrolytic black nickel processing upon a surface of the aluminum base material.

5. A turbomolecular pump according to claim 3, wherein:

the rotor, the fixed vanes, the threaded stator, and the pump base are made from aluminum material;

the second emissivity is imparted to surfaces of the rotary vanes and the rotor by, in order, performing non-electrolytic nickel plating processing and non-electrolytic black nickel plating processing upon surface of the aluminum material;

the first emissivity is imparted to surfaces of the rotary vanes by performing non-electrolytic nickel plating processing upon surface of aluminum material;

the first emissivity is imparted to surfaces of the fixed vanes by exposing base material of the aluminum material; and the second emissivity is imparted to surfaces of the fixed vanes, the threaded stator, and the pump base by performing alumite processing or non-electrolytic black nickel plating processing upon surface of the aluminum material.

6. A method of manufacturing a rotor used in a turbomolecular pump according to claim 5, comprising:

a first process of performing non-electrolytic nickel plating processing upon surface of the rotor that is made from aluminum;

a second process of performing non-electrolytic black nickel plating processing upon upper surface of non-electrolytic nickel plating that has been formed upon the rotor; and a third process of, after the second process, exposing the non-electrolytic nickel plating by performing blasting processing upon a surface of the rotor that is included in the first region;

wherein the surface where the non-electrolytic nickel plating is exposed is made as a surface having the first emissivity, and the surface where the non-electrolytic black nickel plating is exposed is made as a surface having the second emissivity.

* * * * *